United States Patent [19]

Doss

[11] Patent Number: 4,913,010

[45] Date of Patent: Apr. 3, 1990

[54] BELT-TYPE PIPE WRENCH

[76] Inventor: Hubert M. Doss, 803 N. Madison, Magnolia, Ark. 71753

[21] Appl. No.: 308,879

[22] Filed: Feb. 8, 1989

[51] Int. Cl.[4] ..... B25B 13/52

[52] U.S. Cl. ..... 81/64; 81/3.43

[58] Field of Search ..... 81/64, 65, 65.2, 3.4, 81/3.41, 3.49, 3.43

[56] References Cited

U.S. PATENT DOCUMENTS 285,048 9/1883 Liljencrantz ..... 81/64

*Primary Examiner*—Frederick R. Schmidt
*Assistant Examiner*—Lawrence Cruz
*Attorney, Agent, or Firm*—Fleit, Jacobson, Cohn, Price, Holman & Stern

[57] ABSTRACT

An elongated lever is provided defining first and second work engaging and handle ends, respectively. The first work engaging end of the lever includes laterally spaced apart elongated abutment portions defining an endwise outwardly opening recess therebetween on the work engaging end of the lever and an elongated flexible strap is anchored to the work engaging end of the lever inwardly of the outer extremity of the recess with the loop extending about the outerside of one of the abutment members remote from the other abutment member including a major portion thereof centered with respect to the recess and disposed outwardly of the abutment members. The strap member and first end of the lever include coacting structure anchoring the loop defining strap member to the lever in a manner enabling the size of the loop defined by the strap member to be adjusted.

8 Claims, 1 Drawing Sheet

BELT-TYPE PIPE WRENCH

BACKGROUND OF THE INVENTION

1. FIELD OF THE INVENTION

This invention relates to an elongated lever having handle and work engaging ends and a pipe encircling strap or belt carried by the work engaging end and usable, in conjunction with work (pipe) engaging abutment portions carried by the work engaging end of the lever, to tightly grip a pipe section intermediate its opposite ends and anchor the pipe section relative to the lever whereby the lever may be utilized to input high rates of rotational torque to the engaged pipe section, the manner of anchoring the strap or belt to the lever and the provision of the work engaging abutment portions on the work engaging end of the lever enabling the lever and strap to be inverted relative to the workpiece engaged thereby for selective application of rotary torque in opposite directions by the lever.

DESCRIPTION OF RELATED ART

Various different forms of pipe wrenches and the like including some of the general structural and operational features of the instant invention are disclosed in U.S. Pat. Nos. 285,048, 406,177, 961,894, 3,064,325 and 4,529,170. However, these previously known pipe wrenches do not include the overall combination of structural and operational features incorporated in the instant invention.

SUMMARY OF THE INVENTION

The pipe wrench of the instant invention has been specifically designed to be used in conjunction with threaded pipe sections used in the well drilling industry and more particularly in conjunction with non-metallic pipe such as fiberglass pipe, although the wrench also may be used on stronger steel pipe.

The pipe wrench is also designed for use as a backup wrench for a power tong when running fiberglass casing into disposal or oil wells. During this usage of the pipe wrench, the wrench may be used to hold one joint of a casing while a power tong threads the other joint into the joint held by the pipe wrench. Still further, a pair of pipe wrenches constructed in accordance with the present invention can be used simultaneously to unscrew two adjacent pipe sections.

Prototype testing of the pipe wrench of the instant invention utilized a 3" wide belt rated to a tensile strength of 39,200 lbs. With a belt of this type and a sufficiently strong lever, very high rotary torque forces may be applied through the wrench to a fiberglass casing or pipe section.

The main object of this invention is to provide a pipe wrench of the belt-type and which may be used in conjunction with plastic or fiberglass pipe sections to impart high rotary torque thereto.

Another object of this invention is to provide a pipe wrench of the belt-type and which may be manufactured in a small number of different sizes for use in conjunction with pipe sections which vary considerably in diametric size.

Another very important object of this invention is to provide a pipe wrench with which a suspension line or cable may be anchored at substantially the center of gravity of the wrench to thereby enable the wrench to be suspended immediately adjacent pipe or casing sections being run in or withdrawn from a well.

A further important object of this invention is to provide a pipe wrench in accordance with the immediately preceding object and wherein the belt or strap portion thereof may be loosened to allow pipe and casing sections (including their collars) to shift longitudinally relative to the tool while the tool is being suspended immediately adjacent a pipe string to thereby enable the wrench to be used in conjunction with successive pipe sections without total removal of the wrench from a string of pipe sections.

Yet another object of this invention is to provide an apparatus which may be used as a clutch or brake in certain rotary torque transfer operations.

Also, an important object of this invention is to provide a tool which may be readily constructed in various different sizes for use in conjunction with various different size workpieces.

A final object of this invention to be specifically enumerated herein is to provide a pipe wrench in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
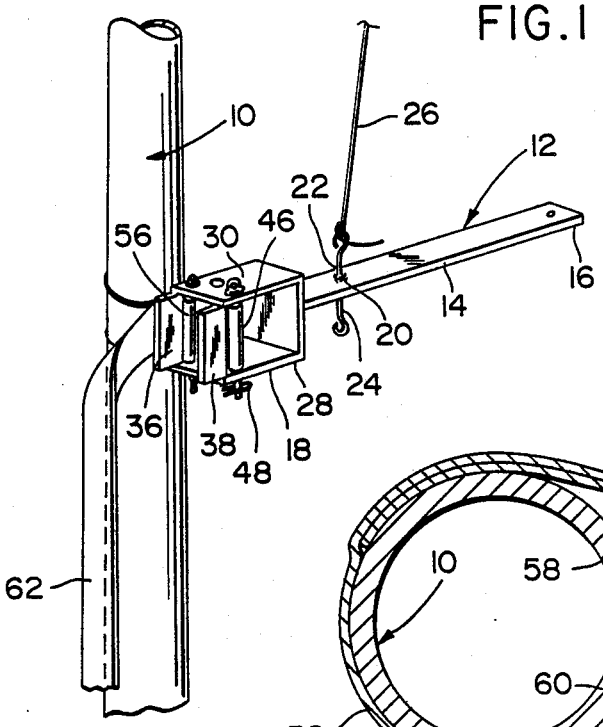
FIG. 1 is a perspective view of the pipe wrench of the invention with a first side thereof uppermost and with the wrench suspended adjacent a pipe string section with which the belt of the wrench is inoperably engaged.

Referring now more specifically to the drawings, the numeral 10 generally designates a pipe section to be turned and comprising a single pipe section of a vertical string of pipe sections. The pipe wrench of the instant invention is referred to in general by the reference numeral 12 and comprises an elongated lever 14 having handle and work engaging ends 14 and 16. The lever 14 includes a point 20 spaced longitudinally therealong comprising the center of gravity of the pipe wrench 12 and upper and lower anchor eyes 22 and 24 project upwardly from and downwardly below the lever 14 as illustrated in FIG. 1 and are aligned with the point 20 defining the center of gravity of the lever 14. A suspension line or cable 26 has its lower end removably anchored relative to the anchor eye 22. Therefore, the pipe wrench 12 is suspended from the cable 26 in substantially horizontal position closely adjacent the string of pipe sections including the pipe section 10.

Figure 4:
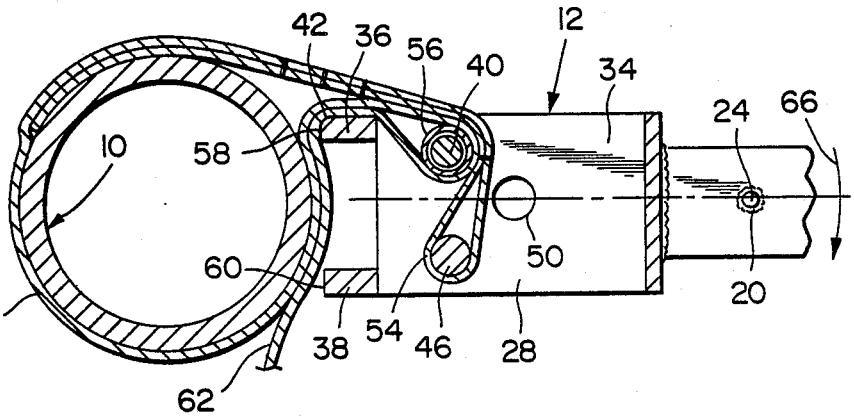
FIG. 4 is a fragmentary horizontal sectional view taken substantially upon the plane indicated by the section line 4—4 of FIG. 2 and illustrating the manner in which the pipe encircling belt is operatively engaged with the work engaging end of the wrench for the purpose of imparting counterclockwise rotary torque forces to the associated pipe section.
Figure 2:
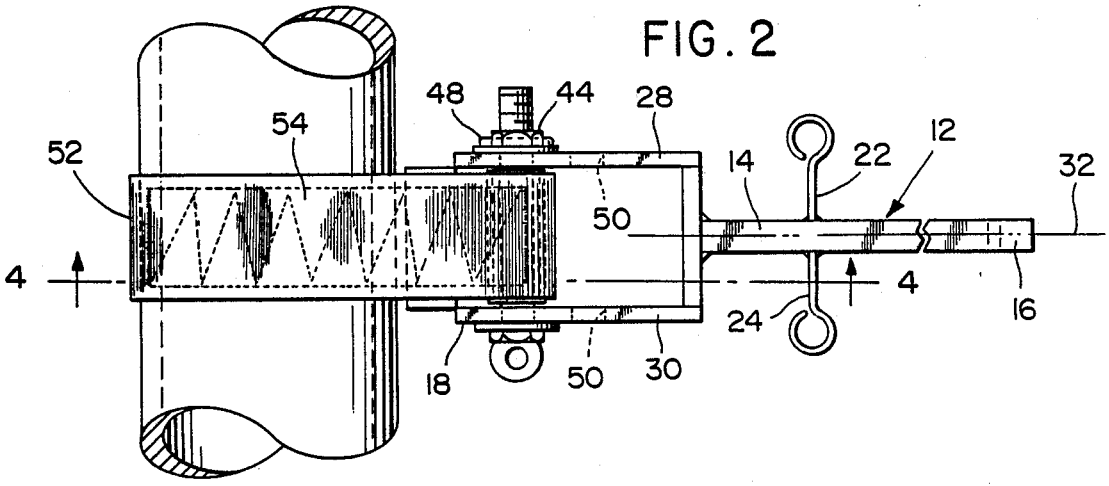
FIG. 2 is an enlarged side elevational view of the wrench and pipe section combination illustrated in FIG. 1, but with the wrench inverted to have the lower side thereof in FIG. 1 uppermost in FIG. 2, the wrench being engaged with the pipe section for imparting counterclockwise rotary torque to the pipe section.
Figure 3:
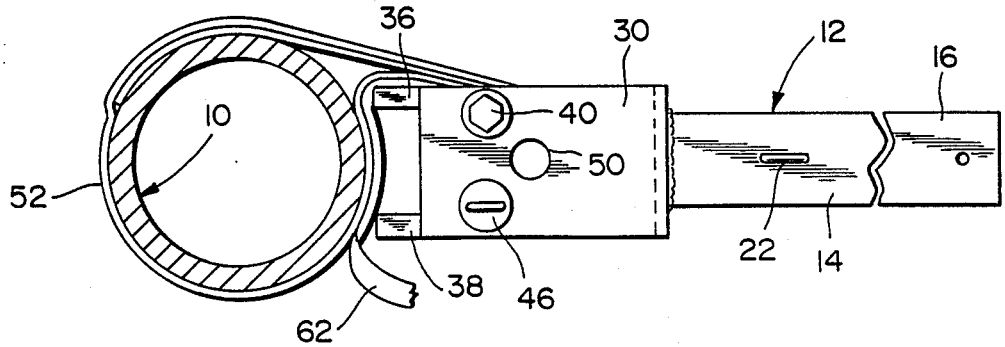
FIG. 3 is a fragmentary top plan view of the wrench illustrated operatively engaged with an attendant pipe section for applying clockwise rotary torque to the pipe section.

With reference now more specifically to FIGS. 2, 3 and 4 of the drawings, the work engaging end 18 of the lever 14 includes a pair of vertically laterally spaced apart, parallel and plate-type furcations 28 and 30 spaced above and below, respectively, the medial plane 32 of the wrench 12 in which the wrench 12 is designed to be swung when tightening or loosening the pipe section 10. In addition, the wrench 12 defines a longitudinal center line 34 along which the point 20 is disposed.

The free edge portions of the furcations 28 and 30 support plate-type abutment portions 36 and 38 rigidly anchored relative to the furcations 28 and 30 on opposite sides of the center line 34 and a first anchor pin 40 is removably secured through the furcations 28 and 30 on the side of the center line 34 on which the abutment portion 36 is disposed, the anchor pin 40 being spaced slightly inward of the outer side 42 of the abutment portion 36 and from the latter toward the handle end 16. The anchor pin 40 comprises a bolt secured through suitable bores (not shown) provided in the furcations 28 and 30 through the utilization of a hut 44. A second anchor pin 46 is secured through a corresponding pair of bores (not shown) formed through the furcations 28 and 30 on the side of the center line 34 remote from the anchor pin 40 and the anchor pin 46 is secured through the furcations 28 and 30 through the utilization of a readily removable pin 48. In addition, the furcations 28 and 30 include corresponding center bores 50 formed therethrough disposed on the center line 34, the purpose for the bores 50 to be more fully set forth hereinafter.

A strong flexible strap 52 has a loop 54 formed in one end thereof and the loop 54 passes about the anchor pin and a rotary sleeve or sleeve roller disposed about that portion of the anchor pin 40 extending between the furcations 28 and 30. The loop equipped end of the strap then extends about the pipe section 10 in the manner illustrated in FIG. 4 of the drawings and over the outerside 42 of the abutment portion 36. The strap thereafter passes about the sleeve or roller 56 and then back over the outerside 42 of the abutment portion 36, across the front faces 58 and 60 of the abutment portions 36 and 38 and is then allowed to hang free as at 62.

When it is desired to initially tighten the strap 52 about the pipe section 10, the pipe wrench 12 is positioned generally in the manner illustrated in FIG. 4 but with the pipe wrench slightly angularly displaced in a counterclockwise direction about the abutment portion 36 from the position thereof viewed in FIG. 4. Then, the free end 62 of the strap 52 is pulled while the pipe wrench 12 is held in position. Then, the pipe wrench is rotated in the direction of the arrow 66 in FIG. 4 back to the position of the wrench 12 illustrated in FIG. 4. During such clockwise angular displacement of the wrench 12 the loop 54 is tightened and the two layers of the strap 52 disposed between the abutment portion 36 and the pipe section 10 are tightly engaged by and about the abutment portion 36, the abutment portion 38 being slightly spaced from the double layer of the strap 52 disposed between the abutment portion 38 and the pipe section 10. Thereafter, further rotary torque in a clockwise direction applied to the handle end 16 of the wrench 12 will even further tighten the strap 52 about the pipe section 10, and impart higher value rotary torque to the pipe section 10 in a clockwise direction as viewed in FIG. 4 of the drawings.

The abutment portion 38 is provided not only as a safety limit for angular displacement of the pipe wrench 12, but also as an indicator of proper tensioning of the strap 52 prior to the application of turning torque to the pipe section 10 through the wrench 12. If the abutment portion 38 engages the double layer of strap 52 disposed between the abutment portion 38 and the pipe section 10 before the strap or belt 52 is sufficiently tightened, the wrench 12 will slip relative to the pipe section 10. However, if minimum spacing is present between the abutment portion 38 and the double layer of strap 52 disposed between the abutment portion 38 and the pipe section 10 as maximum rotary torque is applied to the handle end 16 of the wrench 12, the belt or strap 52 was properly tensioned before maximum rotary torque was applied to the wrench 12. Thus, the presence of the abutment portion 38 not only serves as a safety feature but also as a means by which a person operating the wrench 12 may quickly determine the proper tightening of the strap 52 prior to the application of maximum turning torque to the wrench 12.

With a comparison of FIGS. 1 and 4 invited, it may be seen that if the wrench 12 is rotated to a position such as that illustrated in FIG. 1, the strap 52 will be appreciably loosened relative to the pipe section 10. Such loosening of the strap 52 will allow the pipe section 10 to be shifted longitudinally relative to the wrench 12 and even any collars on the pipe section 10 to slip through the strap 52, if desired.

It also may be appreciated from FIG. 4 of the drawings that the pipe wrench 12 could be used as a band-type clutch or brake and that the spacing of the anchor pin 40 relative to the front face 58 of the abutment portion 36 determines the mechanical leverage by which angular displacement of the wrench 12 tightens the strap 52 about the pipe section 10.

The quickly removable anchor pin 46 may, if desired, be secured through the bores 50 for further modification of the torque transferring ability of the pipe wrench 12.

It will be noted from FIG. 4 of the drawings that the pipe wrench 12 may be used in the same manner a ratchet wrench may be used in turning the pipe section 10. Approximately 10° counterclockwise angular displacement of the pipe wrench 12 from the position thereof illustrated in FIG. 4 relative to the pipe section 10 will enable the strap 52 to slip in a counterclockwise direction about the pipe section 10 and return angular displacement of the pipe wrench 12 to the position thereof illustrated in FIG. 4 may then allow further turning of the pipe section 10.

The positioning of the abutment portion 38 relative to the abutment portion 36 is somewhat critical. When maximum torque is being applied to the pipe wrench 12 and the abutment portion 38 is slightly spaced from the adjacent double layer of strap 52, it will be noted that very little (if any) inward force of the abutment portion 36 on the pipe section 10 is exerted when the pipe wrench 12 is angularly displaced in the direction of the arrow 66, the double thickness sections of strap 52 passing about the corner defined by the intersection of the outerside 52 and the front face 58 actually comprising the fulcrum point of any angular displacement of the wrench 12 relative to the pipe section 10 as full tensioning of the strap 52 is achieved by angular displacement of the wrench 12 in the direction of the arrow 66. Hence, the application of high rotary torque forces to the pipe section 10 through the wrench 12 does not tend to inwardly collapse any local wall portion of the pipe section 10. If, however, the strap 52 is substantially fully tightened when the spacing between the abutment portion 38 and the pipe section 10 is four or five times that illustrated in FIG. 4, the application of rotary torque to the pipe wrench 12 in the direction of the arrow 66 will cause considerable radial inward pressure to be applied to that portion of the pipe section 10 disposed immediately inward of the front face 58 of the abutment portion 36. Consequently, the existence of the abutment portion 38 is most important.

As hereinbefore set forth, the wrench 12 may be used to apply rotary torque in the opposite direction merely by reversing the wrench 12 (top to bottom) in relation to the pipe section 10.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with an elongated member to be angularly displaced about an axis generally paralleling said elongated member, a wrench for gripping and applying rotary torque to said elongated member at a location spaced intermediate the opposite ends of said elongated member, said wrench including an elongated lever defining a first work engaging end and a second handle end and defining a medial plane in which said lever is adapted to be angularly displaced about an axis spaced outward of said first work engaging end and disposed normal to said plane, said lever including laterally spaced longitudinally extending first and second opposite sides facing in opposite directions in said plane, said first work engaging end defining first and second elongated, laterally spaced apart abutment portions facing outward of said first work engaging end, closely opposing peripherally spaced portions of said elongated member and disposed generally normal to said plane adjacent said first and second opposite sides, respectively, of said lever, said first work engaging end defining a recess between said abutment portions opening outwardly of said first work engaging end, an elongated strap, said lever including first and second post means disposed generally normal to said plane and spaced apart transversely of said lever adjacent said first side and said second side, respectively, and spaced toward said second end from said abutment portions, one end of said strap having a closed loop formed therein through which said second post means extends and extending from said second post means towards and over the outer side of said first post means facing outwardly of said lever first side and thereafter about said elongated member and between the latter and said second abutment portion, across said recess, toward and over the outer side of said first abutment portion facing outwardly of said lever first side, over the outer side of said first post means between the latter and said one end of said strap, about said first post means and thereafter back toward and over said outer side of said first abutment portion in contact therewith and thereafter from said first abutment portion back across said recess and said second abutment portion between the latter and the portion of said strap extending about said elongated member, said portion of said strap extending about said elongated member being tightly encircled thereabout with the portions of said strap passing over said first abutment portion between the latter and said elongated member tightly compressed relative to each other and said first abutment portion as said second lever end is swung in said plane in the direction in which said second side of said lever faces while said second abutment portion is at least slightly spaced from the portions of said strap disposed between said second abutment portion and said elongated member.

2. The combination of claim 1 wherein said lever first end includes laterally spaced, plate-type furcations generally paralleling said plane and between which said abutment portions extend.

3. The combination of claim 1 wherein said lever first end includes laterally spaced, plate-type furcations generally paralleling said plane and between which said post means extend.

4. The combination of claim 3 wherein said abutment portions also extend between said plate-type furcations.

5. The combination of claim 4 wherein said furcations and at least said second post means include coacting mounting means removably mounting at least said second post means from said furcations.

6. The combination of claim 5 wherein said coacting mounting means also includes means removably mounting said first post means from said furcations.

7. The combination of claim 1 wherein said lever includes a center of gravity point spaced between the opposite ends thereof, and suspension anchor means projecting outwardly of said lever on opposite sides of said plane at least generally registered with said point to which the lower end of a suspension member may be removably anchored.

8. In combination with an elongated member to be angularly displaced about an axis generally paralleling said elongated member, a wrench for gripping and applying rotary torque to said elongated member at a location spaced intermediate the opposite ends of said elongated member, said wrench including an elongated lever defining a first work engaging end and a second handle end and defining a medial plane in which said lever is adapted to be angularly displaced about an axis spaced outward of said first work engaging end and disposed normal to said plane, said lever including laterally spaced longitudinally extending first and second opposite sides facing in opposite directions in said plane, said first work engaging end defining first and second elongated, laterally spaced apart first and second abutment portions facing outward of said first work engaging end, closely opposing peripherally spaced portions of said elongated member and disposed generally normal to said plane adjacent said first and second sides, respectively, of said lever, said work engaging end defining a recess between said abutment portions opening outwardly of said first work engaging end, an elongated strap, said lever including anchor means spaced from said first work engaging end toward said second handle end, one end portion of said strap being anchored relative to said anchor means and extending form said anchor means toward said first work engaging end and over the outer side of said first abutment portion facing outwardly of said lever first side and thereafter about said elongated member and between the latter and said second abutment portion, across said recess toward said first abutment portion and then over said outer side of said first abutment portion between the latter and said one end portion of said strap, said second abutment portion being abuting engagable with the portion of said strap extending about said elongated member between the latter and said second abutment portion to limit angular displacement of said lever in said plane relative to said elongated member in a direction displacing said second abutment portion toward said elongated member.

* * * * *